US008640493B1

(12) United States Patent
Shivers, III et al.

(10) Patent No.: US 8,640,493 B1
(45) Date of Patent: Feb. 4, 2014

(54) METHOD FOR LIQUEFACTION OF NATURAL GAS OFFSHORE

(71) Applicant: FLNG, LLC, Houston, TX (US)

(72) Inventors: Robert Magee Shivers, III, Houston, TX (US); Richard Paul Michel, Houston, TX (US); Marcus LaRoy Morris, Katy, TX (US); Ned Phillip Baudat, New Braunfels, TX (US); Norman Paul Kolb, Houston, TX (US)

(73) Assignee: FLNG, LLC, Houston, TX (US)

( * ) Notice: Subject to any disclaimer, the term of this patent is extended or adjusted under 35 U.S.C. 154(b) by 0 days.

(21) Appl. No.: 13/848,002

(22) Filed: Mar. 20, 2013

(51) Int. Cl.

| | |
|---|---|
| ***F17C 3/08*** | (2006.01) |
| ***F17C 7/02*** | (2006.01) |
| ***F17C 13/08*** | (2006.01) |
| ***F25J 1/00*** | (2006.01) |
| ***B63B 22/02*** | (2006.01) |
| ***E02B 3/24*** | (2006.01) |

(52) U.S. Cl.
USPC ..... 62/611; 62/45.1; 62/50.1; 62/53.2; 62/606; 114/230.14; 114/230.17

(58) Field of Classification Search
USPC ..... 62/52.3, 606, 611, 613, 45.1, 50.1, 62/50.2; 114/230.14, 230.17, 387
See application file for complete search history.

(56) References Cited

U.S. PATENT DOCUMENTS

| | | | | |
|---|---|---|---|---|
| 4,317,474 | A * | 3/1982 | Kentosh | 141/1 |
| 4,433,940 | A | 2/1984 | Harrison | |
| 5,025,860 | A * | 6/1991 | Mandrin | 166/267 |
| 5,878,814 | A | 3/1999 | Breivik et al. | |
| 5,983,931 | A | 11/1999 | Ingebrigtsen et al. | |
| 6,003,603 | A * | 12/1999 | Breivik et al. | 166/357 |
| 6,412,302 | B1 | 7/2002 | Foglietta | |
| 6,793,712 | B2 | 9/2004 | Qualls | |
| 6,889,522 | B2 * | 5/2005 | Prible et al. | 62/611 |
| 6,973,948 | B2 | 12/2005 | Pollack et al. | |
| 6,997,643 | B2 | 2/2006 | Wille et al. | |
| 7,007,623 | B2 | 3/2006 | Boatman et al. | |
| 7,080,673 | B2 | 7/2006 | Pollack et al. | |
| 7,318,319 | B2 | 1/2008 | Hubbard et al. | |
| 7,360,367 | B2 | 4/2008 | Hubbard et al. | |
| 7,478,975 | B2 | 1/2009 | Hubbard et al. | |
| 7,600,396 | B2 | 10/2009 | Mak | |
| 7,717,762 | B2 * | 5/2010 | Boatman et al. | 441/3 |
| 7,958,835 | B2 | 6/2011 | Srinivasan | |
| 8,037,694 | B2 | 10/2011 | Runbalk | |
| 8,100,076 | B1 * | 1/2012 | Shivers et al. | 114/230.14 |
| 8,104,416 | B1 | 1/2012 | Shivers et al. | |

(Continued)

*Primary Examiner* — Frantz Jules
*Assistant Examiner* — Keith Raymond
(74) *Attorney, Agent, or Firm* — Buskop Law Group, PC; Wendy Buskop

(57) ABSTRACT

Method for processing, treatment and liquefaction of natural gas proximate offshore gas fields with a gas floating production storage and offloading vessel with a primary processing unit, a gas treating unit, and a natural gas compressor. The liquefaction is split between a liquefied natural gas transport vessel moored on a disconnectable turret and the floating production storage and offloading vessel. High pressure liquefied natural gas inlet quality gas from the vessel is sent through conduits to the liquefied natural gas transport vessel(s) then back through the disconnectable turrets to the vessel. A separate nitrogen refrigerant on the transport vessel provides final stage liquefaction while being powered by the transport vessel's propulsion plant. When the transport vessel is full, the transport vessel disconnects from the disconnectable turret, and motors to a transfer terminal located in sheltered water for transfer of liquefied natural gas cargo to a standard trading tanker.

9 Claims, 6 Drawing Sheets

(56) References Cited

U.S. PATENT DOCUMENTS

| | | | | |
|---|---|---|---|---|
| 2007/0095427 | A1 | 5/2007 | Ehrhardt et al. | |
| 2010/0108145 | A1 | 5/2010 | Danaczko et al. | |
| 2011/0265494 | A1* | 11/2011 | Barclay | 62/45.1 |
| 2012/0024391 | A1 | 2/2012 | Wille et al. | |
| 2012/0317996 | A1 | 12/2012 | Lee | |
| 2013/0025726 | A1* | 1/2013 | Dupont | 137/899.2 |

* cited by examiner

METHOD FOR LIQUEFACTION OF NATURAL GAS OFFSHORE

FIELD

The present embodiments generally relate to a method for vessel power assisted liquefaction of natural gas offshore.

BACKGROUND

A need exists for a method for processing natural gas offshore using a free floating disconnectable turret that can easily attach and reattach and fluidly connect an liquefied natural gas transport vessel to a floating production storage and offloading vessel, allowing the liquefied natural gas transport vessel to assist in processing the natural gas, and transport liquefied natural gas wherein the liquefied natural gas transport vessel does not need to tie up alongside a floating platform and the vessel power plant is used to assist in liquefaction of the natural gas into liquefied natural gas.

A further need exists for method for low pressure processing of natural gas offshore that produces liquefied natural gas for transport.

The present embodiments meet these needs.

BRIEF DESCRIPTION OF THE DRAWINGS

The detailed description will be better understood in conjunction with the accompanying drawings as follows.

Figure 1:
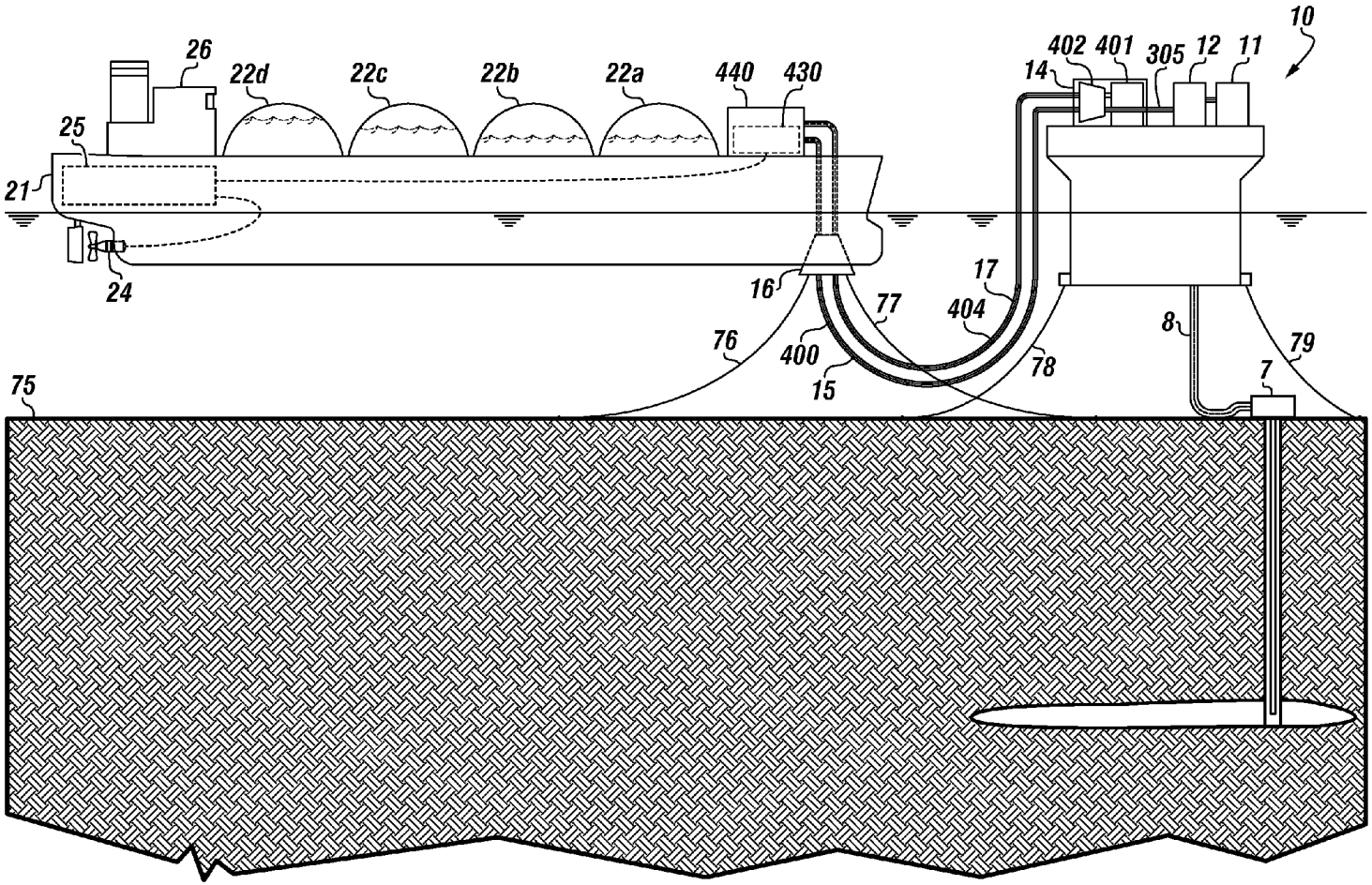
FIG. 1 is a diagram of the liquefied natural gas transport vessel connected to the disconnectable turret and the floating production storage and offloading vessel usable in an embodiment of the method.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The invention relates to a method for low pressure processing of natural gas including liquefaction of natural gas proximate an offshore gas field using a floating production storage and offloading vessel.

The method for offshore liquefaction of natural gas and transport of produced liquefied natural gas to a trading tanker involves first flowing well gas from the well into a primary processing unit mounted on the floating production storage and offloading vessel.

The floating production storage and offloading vessel can perform several steps.

First, the floating production storage and offloading vessel can separate condensate and water from the well gas forming a high pressure flash gas.

Next, the floating production storage and offloading vessel can send high pressure flash gas to a gas treatment unit on the floating production storage and offloading vessel.

The third step can include removing acid gas from the high pressure flash gas forming a treated gas on the floating production storage and offloading vessel.

As a fourth step, water can be removed from the treated gas forming a dry gas that is sent to a dehydration unit.

As a fifth step on the floating production storage and offloading vessel, propane, butane, pentane and heavier hydrocarbon compounds can be removed from the dry gas forming a liquefied natural gas inlet quality gas.

As a sixth step, the liquefied natural gas inlet quality gas can be compressed on the floating production storage and offloading vessel forming a high pressure liquefied natural gas inlet quality gas.

The next step of the method can include the floating production storage and offloading vessel transferring the high pressure liquefied natural gas inlet quality gas to the disconnectable turret using a first flexible conduit.

The disconnectable turret can then transfer the high pressure liquefied natural gas inlet quality gas from the disconnectable turret to a liquefaction unit on a liquefied natural gas transport vessel.

On the liquefied natural gas transport vessel, a first portion of the high pressure liquefied natural gas inlet quality gas can be liquefied and expanded for storage as liquefied natural gas. A second portion of the high pressure liquefied natural gas inlet quality gas can be cooled, expanded, and recompressed into a recycle gas stream.

As a next step of the method, the liquefied natural gas transport vessel can export the recycle gas stream through a second flexible conduit to the disconnectable turret.

The disconnectable turret can then export the recycle gas stream to the floating production storage and offloading vessel.

On the floating production storage and offloading vessel, the recycle gas stream can then be compressed and blended with the high pressure liquefied natural gas inlet quality gas.

Upon completion of the export of the recycle gas stream from the liquefied natural gas transport vessel, the liquefied natural gas transport vessel can disconnect from the disconnectable turret and travel to a transfer terminal for offloading to a trading tanker.

The present embodiments describe a gas floating production storage and offloading vessel that is usable in the method that can accomplish: (a) primary processing, which can include separation, flash gas compression, condensate stabilization and water treatment; (b) gas pre-treatment, which can include acid gas removal, dehydration and hydrocarbon dewpointing; and (c) gas recycle compression.

In embodiments, the floating production storage and offloading vessel can be used for storage and offloading of stabilized condensate.

In implementing the method, one or more modified Moss type liquefied natural gas carriers can be moored on a disconnectable turret.

High pressure gas from a floating production storage and offloading vessel is sent through flexible pipelines to the liquefied natural gas carrier through the turret and back to the floating production storage and offloading vessel. The gas cycle can provide most of the refrigerant duty. A separate nitrogen refrigerant on board the liquefied natural gas carrier can provide the final stage of liquefaction and can be powered electrically by the ship's main propulsion plant in this method.

According to this method, when the liquefied natural gas carrier is full, the liquefied natural gas transport vessel can disconnect from the turret mooring and motor to a transfer jetty located in sheltered water where it can safely transfer the liquefied natural gas cargo to a standard trading tanker. Alternative, in areas with relatively benign metocean conditions, the liquefied natural gas carrier can be offloaded directly in open water by a dynamically positioned liquefied natural gas shuttle tanker.

Significant natural gas reserves are discovered each year offshore in areas where there is little or no commercial market for the gas on nearby landmass due to the remote location of the natural gas reserves or due to a lack of industrial and commercial infrastructure. Where the reserves are large enough, conventional onshore liquefied natural gas plants are used to liquefy, store and load the gas onto liquefied natural gas tankers for transport to markets in other countries.

The present method provides a cost effective means of developing small and mid-size offshore gas discoveries in remote regions.

The present method details processing steps used for producing liquefied natural gas, which can include primary production, gas treatment, gas liquefaction and storage of liquefied natural gas, condensate, and sometimes production and storage of liquefied petroleum gas.

The present method can partition the various stages of the liquefied natural gas process between two or more vessels in order to utilize vessels of a standard design and thereby reduce schedule and overall costs and reduce project execution risk. There is no need to use an extremely large specially designed vessel with this method.

The system for use with this method can reliably operate not only in benign metocean conditions, but also in ocean conditions with a significant wave height of greater than 2 meters.

The method can provide reliable operations in severe metocean conditions because no offshore transfer of liquefied natural gas cargo is required.

For gas liquefaction and liquefied natural gas storage, the method can use one or more modified Moss type liquefied natural gas carriers each moored on a disconnectable turret, wherein the plurality of turrets can engage one or more floating production storage and offloading vessels.

A Moss type liquefied natural gas carrier is proposed for use in this method due to the ability of the spherical tanks to tolerate liquefied natural gas sloshing effects in severe seas, but other liquefied natural gas containment systems such as membrane type systems can be used. The Moss liquefied natural gas carrier can utilize a dual fuel diesel electric main power plant for propulsion and, according to this novel method, to assist with liquefaction.

In this method, high pressure gas from the floating production storage and offloading vessel can be sent through flexible pipelines to the liquefied natural gas carrier through the turret. A portion of the gas, typically 25 percent to 30 percent, can be liquefied and remain on board the floating production storage and offloading vessel in storage.

The remaining portion of the high pressure gas can be cooled by expansion to lower pressure and be used as a primary refrigerant in the liquefaction process and returned to the floating production storage and offloading vessel through separate flexible pipelines. The gas refrigerant cycle can provide most of the liquefied natural gas liquefaction duty, such as 60 percent to 70 percent.

A separate nitrogen refrigerant on board the Moss type liquefied natural gas carrier can provide the final stage of liquefaction, typically 30 percent to 40 percent, and can be powered electrically by the ships main propulsion plant.

Alternatively, in areas with relatively benign to moderate metocean conditions, the liquefied natural gas carrier can be offloaded directly in open water by a dynamically positioned liquefied natural gas shuttle tanker in either side by side or tandem offloading configuration.

According to this method, the floating production storage and offloading vessel can have a primary processing unit, a gas treatment unit, and a natural gas compressor.

One or more liquefied natural transport vessels can be moored, each on a disconnectable turret for connection to the floating production storage and offloading vessel.

High pressure liquefied natural gas inlet quality gas from the floating production storage and offloading vessel can be sent through flexible conduits to each liquefied natural gas transport vessel through one of the disconnectable turrets and back to the floating production storage and offloading vessel. The natural gas cycle can provide most of the refrigerant duty.

This method is intended for use with small, midsized and large reserves.

The present method uses a ship based liquefaction system disconnectable from the floating production storage and offloading vessel.

In one version, the first stationary flowing vessel can be a floating production storage and offloading vessel, which can be a ship shaped vessel, a spread moored circular vessel such as a SEVAN® type, a semisubmersible unit, a barge, or similar vessel, or in shallow water, a fixed platform.

Turning now to the Figures, FIG. 1 is a diagram of the liquefied natural gas transport vessel connected to the disconnectable turret and the floating production storage and offloading vessel.

The floating production storage and offloading vessel 10 can be connected to a disconnectable turret 16 via a first flexible conduit 15 at a first pressure. The disconnectable turret 16 can be held to the seafloor 75 using mooring cables 76 and 77.

The floating production storage and offloading vessel can be moored to the seafloor 75 with mooring cables 78 and 79.

The floating production storage and offloading vessel can be connected to a well 7 by means of a subsea flow line and riser 8.

The floating production storage and offloading vessel can be adapted to receive natural gas from the well.

The disconnectable turret 16 can connect back to the floating production storage and offloading vessel 10 via a second flexible conduit 17 at a second pressure.

The disconnectable turret 16 can receive high pressure liquefied natural gas inlet quality gas 400 via the first flexible conduit 15 from a natural gas recycle compressor 402 on the floating production storage and offloading vessel 10 at a first pressure from 1200 psia to 2000 psia and at a first temperature from 40 degrees Fahrenheit to 100 degrees Fahrenheit.

Simultaneously, the disconnectable turret 16 can transfer a recycle gas stream 404 through the second flexible conduit 17 to the floating production storage and offloading vessel 10 at a second pressure from 300 psia to 1000 psia and at a second temperature from 50 degrees Fahrenheit to 100 degrees Fahrenheit.

A liquefied natural gas transport vessel 21 can be connected in a removable latching manner to the disconnectable turret 16.

The subsea flow line and riser 8 can convey well gas from the well to a primary processing unit 11 on the floating production storage and offloading vessel 10.

The primary processing unit 11 can process the well gas into a high pressure flash gas stream.

A gas treatment unit 12 can be mounted on the floating production storage and offloading vessel 10 for treating the high pressure flash gas stream to produce a liquefied natural gas inlet quality gas 305.

A natural gas compressor 14 can be mounted to the floating production storage and offloading vessel 10 for receiving the liquefied natural gas inlet quality gas 305 produced by the gas treatment unit 12 and compressing the liquefied natural gas inlet quality gas 305 to a pressure from 1200 psia to 2000 psia transforming the liquefied natural gas inlet quality gas 305 into a high pressure liquefied natural gas inlet quality gas 400.

The natural gas compressor 14 can be made up of the natural gas recycle compressor 402 and a connected gas turbine 401.

In one or more embodiments, a plurality of natural gas compressors can be used in parallel.

The liquefied natural gas transport vessel 21 can have liquefied natural gas storage 22*a*, 22*b*, 22*c*, and 22*d* for receiving the liquefied natural gas from a liquefaction unit 440.

The liquefied natural gas transport vessel 21 can be adapted to latch into the disconnectable turret 16 for a fluid communication with the fluid conduits.

This liquefied natural gas transport vessel can include an inlet port for receiving the high pressure liquefied natural gas inlet quality gas 400 from the disconnectable turret 16 and flowing the gas to the liquefaction unit 440.

A nitrogen recycle compressor 430 is also shown.

The liquefied natural gas transport vessel can have a propulsion means 24, wherein the propulsion means is connected to a dual fuel diesel electric main power plant 25 or a steam turbo-electric plant, wherein the dual fuel diesel electric main power plant or steam turbo-electric plant is electrically connected to the liquefaction unit 440.

The liquefied natural gas transport vessel can have a helm and navigation station 26 connected to the dual fuel diesel electric main power plant 25 for navigating the liquefied natural gas transport vessel.

In one or more embodiments, the disconnectable turret 16 can be used to duplicate the process on one or more liquefied natural gas transport vessel simultaneously, to increase overall liquefaction and storage capacity.

Figure 2:
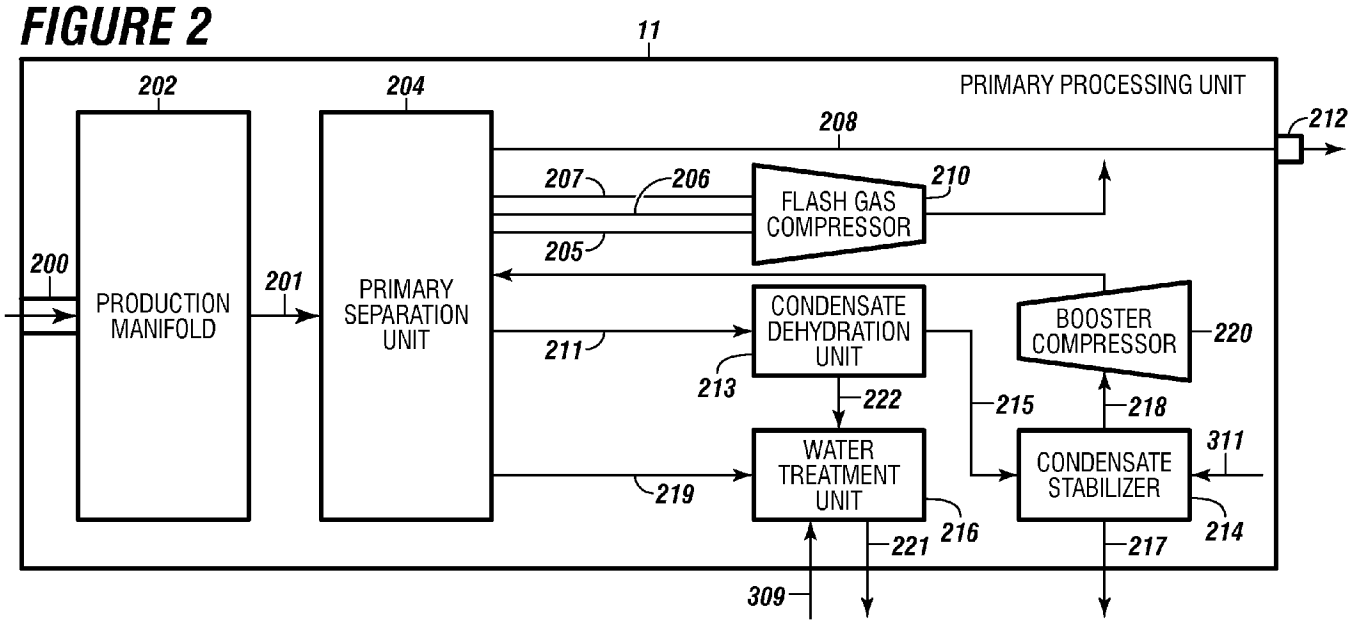
FIG. 2 is a diagram of the primary processing unit on the floating production storage and offloading vessel usable in an embodiment of the method.

FIG. 2 is a diagram of the primary processing unit on the floating production storage and offloading vessel.

The primary processing unit 11 can have a production manifold 202 connected to an inlet 200 for receiving natural gas from a well, such as a subsea well, a platform well, or a similar well, as depicted in FIG. 1.

A primary separation unit 204 can be connected to the production manifold 202 by a wet gas stream 201.

A flash gas compressor 210 can receive a plurality of wet natural gas streams 205, 206, and 207 from the primary separation unit 204.

One of the streams can be a first low pressure wet natural gas at a pressure from 150 psia to 250 psia. Another of the streams can be a second intermediate pressure wet natural gas at a pressure from 400 psia to 600 psia. Still another of the streams can be a third intermediate pressure wet natural gas having a pressure from 900 psia to 1200 psia.

The flash gas compressor 210 can compress the wet natural gases from the wet natural gas streams 205, 206, and 207 and flow the compressed wet natural gas to an outlet 212.

A high pressure flash gas stream 208 can flow directly from the primary separation unit 204 to the outlet 212. The high pressure flash gas can be flowed at a pressure from 1500 psia to 2000 psia.

The wet condensate 211 can be transferred from the primary separation unit 204 to a condensate dehydration unit 213 forming an unstabilized dry condensate 215.

Water 222 can be sent from the condensate dehydration unit 213 to a water treatment unit 216.

A condensate stabilizer 214 can be used for receiving pentanes and heavier hydrocarbon compounds, which the group is herein referred to as "C5+", such as condensate 311, and the unstabilized dry condensate 215, then flowing stabilized condensate 217 to storage in the hull of the floating production storage and offloading vessel and/or the liquefied natural gas transport vessel while sending removed flash gas 218 to a booster compressor 220 and then to the primary separation unit.

The water treatment unit 216 can be connected to the primary separation unit. The water treatment unit can receive untreated produced water 219, form treated water 221, and discharge the treated water 221 to the sea.

Figure 3:
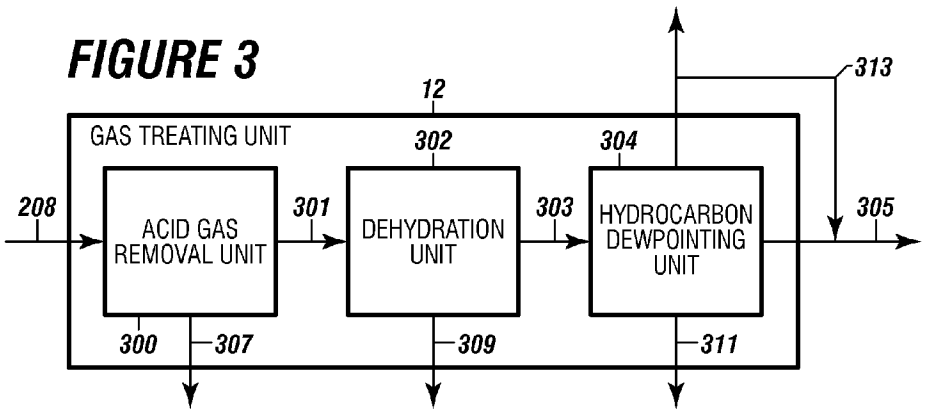
FIG. 3 is a diagram of the gas treating unit on the floating production storage and offloading vessel usable in an embodiment of the method.

FIG. 3 is a diagram of the gas treatment unit on the floating production storage and offloading vessel.

The gas treatment unit 12 can have an acid gas removal unit 300 can be mounted on the first floating production storage and offloading vessel.

The acid gas removal unit 300 can receive the high pressure flash gas stream 208 from the primary processing unit.

The acid gas removal unit can remove acid gas 307, such as $CO_2$ and/or $H_2S$ for venting, flaring or disposal.

A dehydration unit 302 can receive sweetened gas 301 from the acid gas removal unit 300 and remove water vapor to produce dry gas 303.

The condensed water vapor 309 from the dehydration unit 302 can be sent to the water treatment unit 216 (as shown in FIG. 2).

A hydrocarbon dewpointing unit 304 can receive the dry gas 303 and can remove heavy hydrocarbon compounds, such as but not limited, to propane ($C_3$), butane ($C_4$), and pentanes plus ($C_5$+), forming the liquefied natural gas inlet quality gas 305.

The propane and butane can be blended into the liquefied natural gas feed 313, or sent to the liquefied natural gas storage to be sold as a separate product stream. The terms "propane" and "butane" are abbreviated herein as "$C_3$" and "$C_4$" respectively and are often referred to collectively as "liquefied petroleum gas".

In embodiments, condensate 311 from the hydrocarbon dewpointing unit 304 can be removed. The condensate 311 typically contains $C_5$ and heavy hydrocarbons, usually referred to a "pentanes plus" and abbreviated as "$C_5$+". The condensate 311, in embodiments, can be sent to the condensate stabilizer 214 (shown in FIG. 2).

Figure 4:
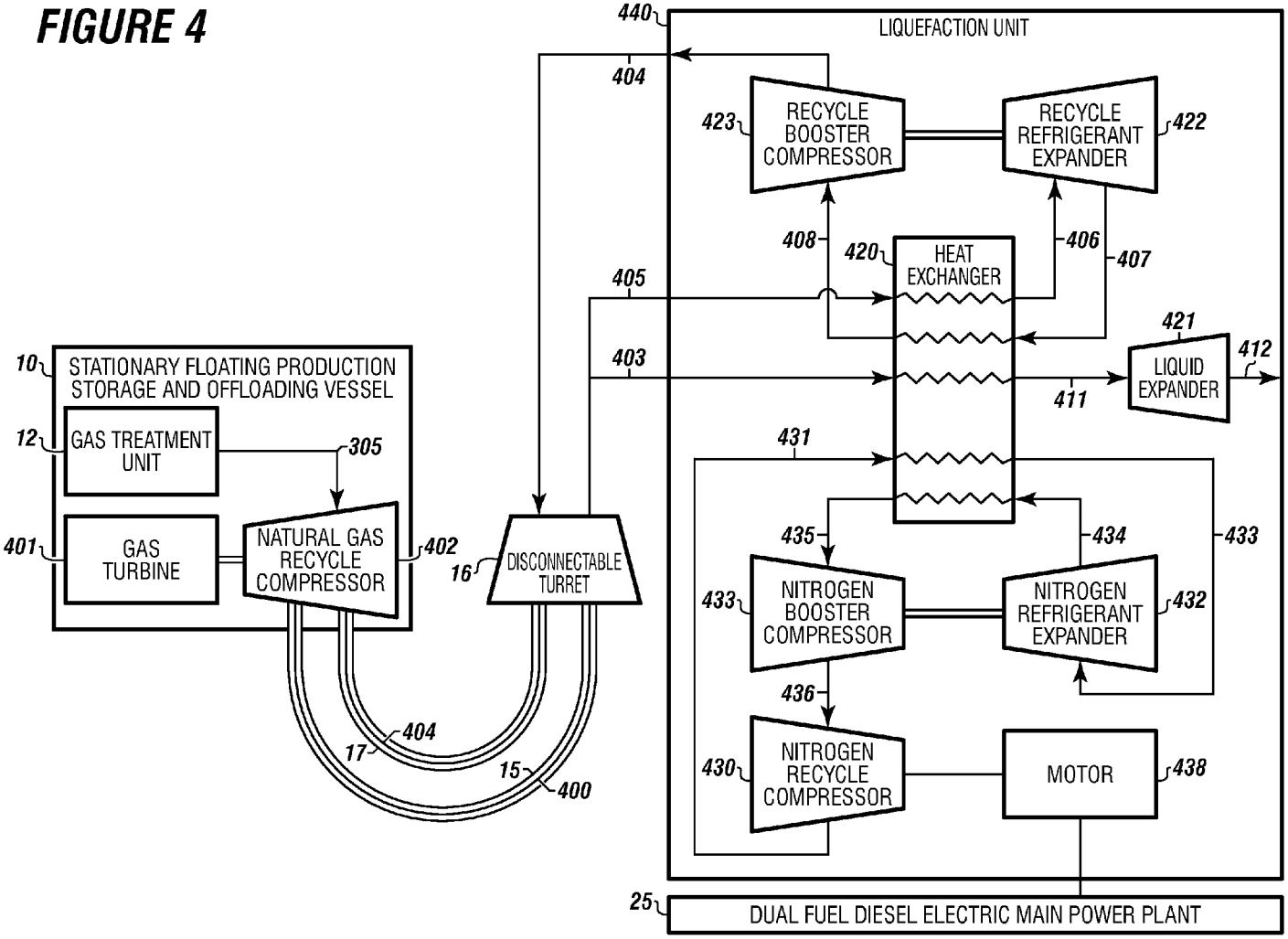
FIG. 4 is a diagram of components of the liquefaction unit as it engages the disconnectable turret and the floating production storage and offloading vessel usable in an embodiment of the method.

FIG. 4 is a diagram of components of the liquefaction system which involves the floating production storage and offloading vessel, the disconnectable turret and the liquefaction unit.

The floating production storage and offloading vessel 10 can have a natural gas recycle compressor 402. The natural gas recycle compressor 402 can be driven by a gas turbine 401.

The natural gas recycle compressor 402 can compress liquefied natural gas inlet quality gas 305 from the gas treatment unit 12 and a recycle gas stream 404.

The liquefaction unit 440, which can be located on the liquefied natural gas transport vessel, can have an inlet port for receiving the high pressure liquefied natural gas inlet quality gas 400 from the disconnectable turret 16 via the first flexible conduit 15. Simultaneously, the disconnectable turret 16 can transfer the recycle gas stream 404 through the second flexible conduit 17 to the floating production storage and offloading vessel 10.

A first portion of the high pressure liquefied natural gas inlet quality gas 400 can be a liquefied natural gas feed gas stream 403 and a second portion of the high pressure liquefied natural gas inlet quality gas 400 can be a recycle refrigerant stream 405.

At least one heat exchanger 420 can receive the liquefied natural gas feed gas stream 403, condense and cool the liquefied natural gas feed gas stream 403 at a high pressure, and produce a liquefied high pressure gas stream 411.

The liquefied high pressure gas stream 411 can flow through a liquid expander 421 forming a low pressure liquefied natural gas stream 412 which can be sent to liquefied natural gas storage.

The heat exchanger 420 can cool the recycle refrigerant stream 405 forming a precooled recycle refrigerant 406 that can be transmitted to a recycle refrigerant expander 422.

A cooled recycle refrigerant 407 can be flowed from the recycle refrigerant expander 422 back to the heat exchanger 420 for use in cooling the liquefied natural gas feed gas stream 403 forming a low pressure recycle refrigerant 408.

The low pressure recycle refrigerant 408 can flow to the recycle booster compressor 423 powered by the recycle refrigerant expander 422 which creates a recycle gas stream 404 that flows back to the disconnectable turret 16.

A nitrogen refrigerant stream 431 can be flowed into the heat exchanger 420 to cool the refrigerant, forming a cooled nitrogen refrigerant stream 433.

A nitrogen refrigerant expander 432 can receive the cooled nitrogen refrigerant stream 433 and form a cold nitrogen refrigerant 434 for use in cooling the liquefied natural gas feed gas stream 403 with the heat exchanger 420 and forming a low pressure nitrogen refrigerant 435.

The low pressure nitrogen refrigerant 435 can flow from the heat exchanger 420 to a nitrogen booster compressor 433 powered by the nitrogen refrigerant expander 432 to receive the low pressure nitrogen refrigerant 435 forming the nitrogen recycle stream 436.

The nitrogen recycle stream 436 can be received by the nitrogen recycle compressor 430 which is powered by a motor 438 that can be electrically connected to the ship's dual fuel diesel electric main power plant 25.

Figure 5:
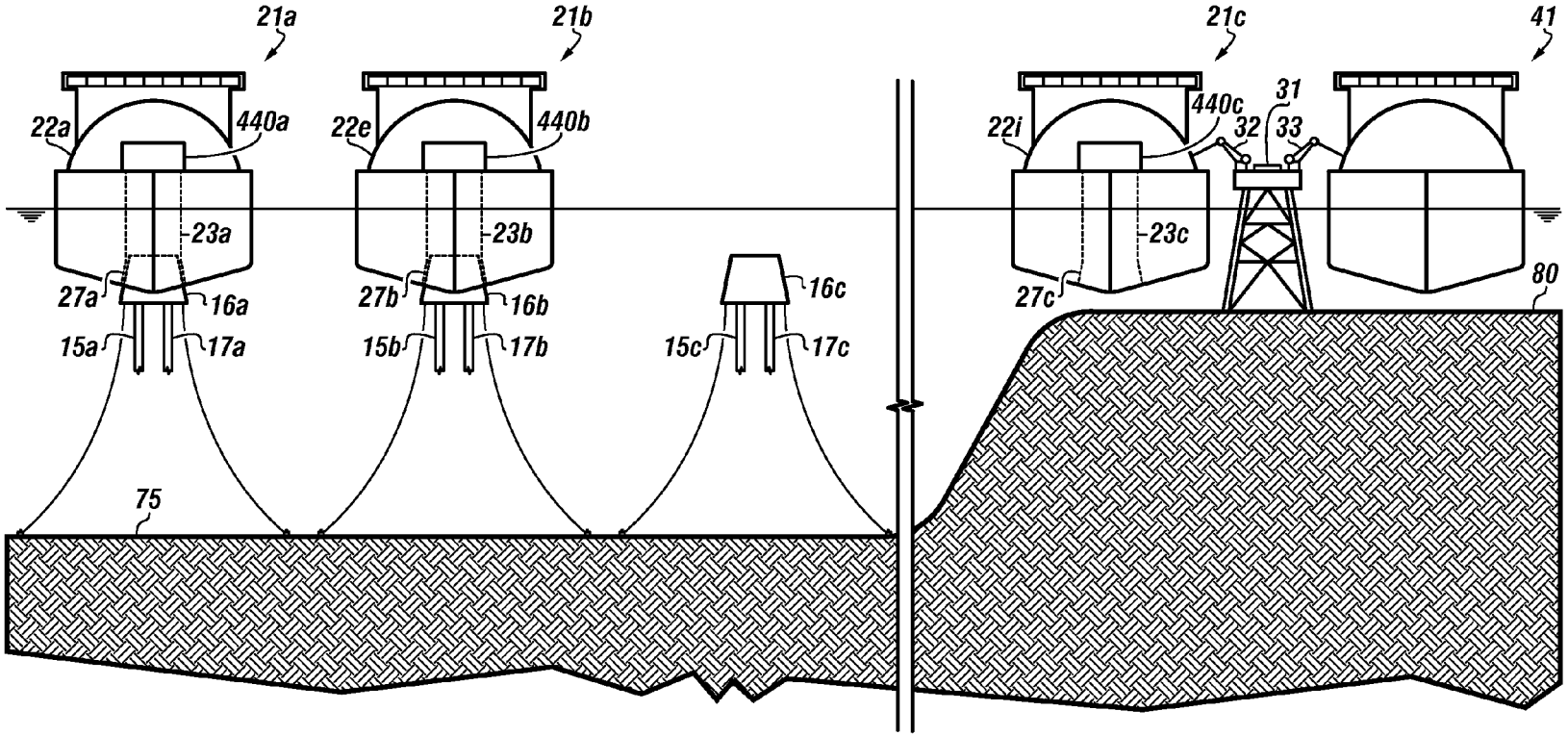
FIG. 5 is a diagram depicting the offloading arrangements and transfer jetty using a plurality of transport vessels and a plurality of disconnectable turrets usable in an embodiment of the method.

FIG. 5 is a diagram depicting the offloading arrangements and transfer jetty using a plurality of liquefied natural gas transport vessels and a plurality of disconnectable turrets.

A plurality of liquefied natural gas transport vessels 21*a*, 21*b*, and 21*c* are shown, wherein liquefied natural gas transport vessels 21*a* and 21*b* are connected to disconnectable turrets 16*a* and 16*b*.

Disconnectable turret 16*a* can connect to the first flexible conduit 15*a* and the second flexible conduit 17*a* which can engage the floating production storage and offloading vessel, not shown in this Figure.

Disconnectable turret 16*b* can connect to the first flexible conduit 15*b* and second flexible conduit 17*b* which can engage the floating production storage and offloading vessel.

A third disconnectable turret 16*c* is depicted with the liquefied natural gas transport vessel disconnected. The disconnectable turret 16*c* can have a first flexible conduit 15*c* and a second flexible conduit 17*c* keeping the third disconnectable turret 16*c* ready to operate.

The liquefied natural gas transport vessel 21*a* can have a liquefaction unit 440*a*, which can be electrically connected to the dual fuel diesel electric main power plant of the vessel.

The liquefied natural gas transport vessel 21*a* can have a liquefied natural gas storage 22*a*, a turret receptacle 27*a* and a means to recover (pick up out of the sea) and latch onto the disconnectable turret, which can be a buoy. The turret receptacle 27*a* can have a turret trunk 23*a*, which can contain fluid swivels that can be gas swivels, and piping that can be connected and disconnected to the disconnectable turret to provide a fluid connection with the disconnectable turret. Each of the swivels can be conveniently and quickly connectable and disconnectable with the fluid conduits in the disconnectable turret.

The liquefied natural gas transport vessel 21*b* can have a liquefaction unit 440*b*, which can be electrically connected to the dual fuel diesel electric main power plant.

The liquefied natural gas transport vessel 21*b* can have a liquefied natural gas storage 22*e*, a turret receptacle 27*b*, and a means to recover and latch onto the disconnectable turret. The turret receptacle 27*b* can have a turret trunk 23*b*.

A liquefied natural gas transport vessel 21*c* can have a liquefaction unit 440*c*, which can be electrically connected to the dual fuel diesel electric main power plant.

The liquefied natural gas transport vessel 21*c* can have a liquefied natural gas storage 22*i*, a turret receptacle 27*c*, and a means to recover and latch onto the disconnectable turret. The turret receptacle 27*c* can have a turret trunk 23*c*.

A transfer terminal 31 is shown secured to the shallow seafloor 80 in sheltered or calm, shallow water.

Articulated liquefied natural gas loading arms 32 and 33 are depicted. Articulated liquefied natural gas loading arm 32 is shown connected to the liquefied natural gas transfer vessel 21*c*. Articulated liquefied natural gas loading arm 33 is shown connected to a liquefied natural gas trading tanker 41 for receiving the cargo from the liquefied natural gas transport vessel 21*c*.

In one or more embodiments, the articulated liquefied natural gas loading arms can be replaced with hoses.

In other embodiments, in benign water with predominant wave height less than 2 meters, a dynamically positioned shuttle tanker can be used to directly connect to the liquefied natural gas transport vessels and offload in a side by side or tandem configuration after the liquefied natural gas transport vessels have disconnected from the disconnectable turret.

Figure 6A:
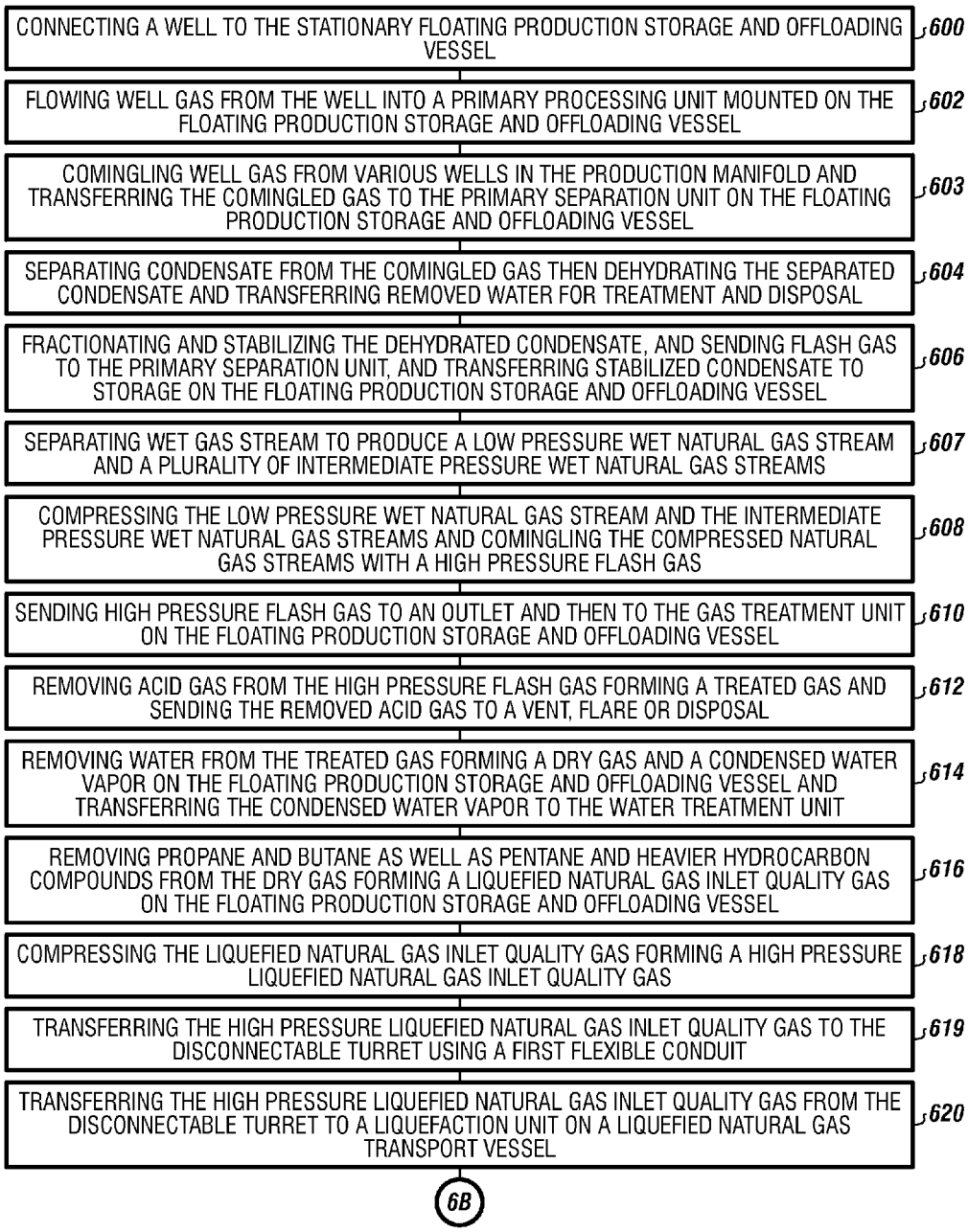
FIGS. 6A and 6B are a diagram of the sequence of steps used in an embodiment of the method.
Figure 6B:
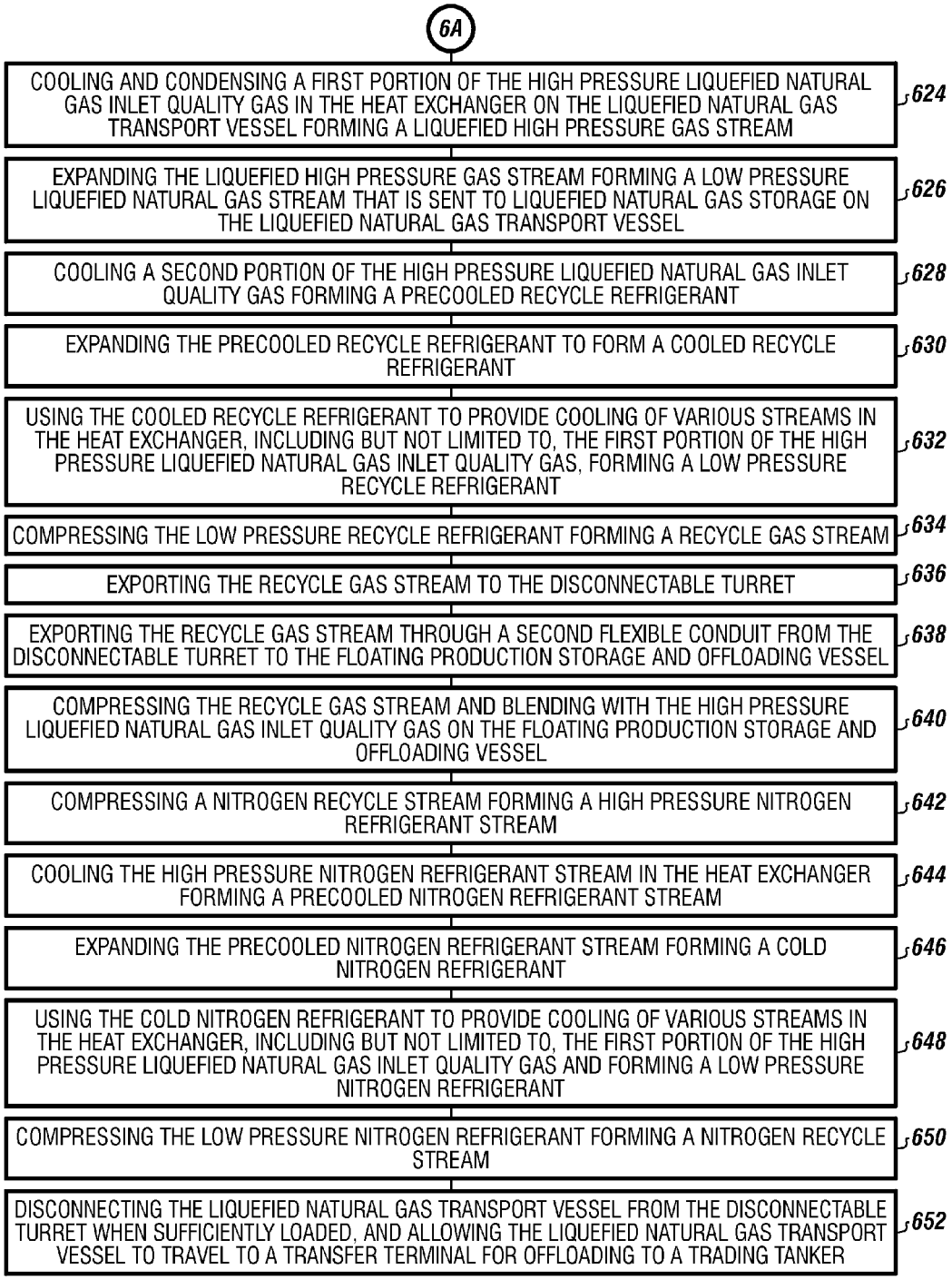

FIGS. 6A and 6B are a diagram of the sequence of steps that can be used with an embodiment of the system.

The system can perform connecting a well to the floating production storage and offloading vessel, as shown in step 600.

The system can perform flowing well gas from the well into a primary processing unit mounted on the floating production storage and offloading vessel, as shown in step 602.

The system can perform comingling well gas from various wells in the production manifold and transferring the comingled gas to the primary separation unit on the floating production storage and offloading vessel, as shown in step 603.

The system can perform separating condensate from the comingled gas then dehydrating the separated condensate and transferring removed water for treatment and disposal, as shown in step 604.

The system can perform fractionating and stabilizing the dehydrated condensate, and sending flash gas to the primary separation unit, and transferring stabilized condensate to storage on the floating production storage and offloading vessel, as shown in step 606.

The system can perform separating wet gas stream to produce a low pressure wet natural gas stream and a plurality of intermediate pressure wet natural gas streams, as shown in step 607.

The system can perform compressing the low pressure wet natural gas stream and the intermediate pressure wet natural gas streams and comingling the compressed natural gas streams with a high pressure flash gas, as shown in step 608.

The system can perform sending high pressure flash gas to an outlet and then to the gas treatment unit on the floating production storage and offloading vessel as shown in step 610.

The system can perform removing acid gas from the high pressure flash gas forming a treated gas and sending the removed acid gas to a vent, flare or disposal, as shown in step 612.

The system can perform removing water from the treated gas forming a dry gas and a condensed water vapor on the floating production storage and offloading vessel and transferring the condensed water vapor to the water treatment unit, as shown in step 614.

The system can perform removing propane and butane as well as pentane and heavier hydrocarbon compounds from the dry gas forming a liquefied natural gas inlet quality gas on the floating production storage and offloading vessel, as shown in step 616.

In this step, the pentane and heavier hydrocarbon compounds can be transferred to the condensate stabilizer.

Also in this step, the removed propane and butane can be blended into the liquefied natural gas inlet quality gas or the removed propane and butane can be sold as a separate product stream.

The system can perform compressing the liquefied natural gas inlet quality gas forming a high pressure liquefied natural gas inlet quality gas, as shown in step 618.

The system can perform transferring the high pressure liquefied natural gas inlet quality gas to the disconnectable turret using a first flexible conduit, as shown in step 619.

The system can perform transferring the high pressure liquefied natural gas inlet quality gas from the disconnectable turret to a liquefaction unit on a liquefied natural gas transport vessel 21, as shown in step 620.

The system can perform cooling and condensing a first portion of the high pressure liquefied natural gas inlet quality gas in the heat exchanger on the liquefied natural gas transport vessel forming a liquefied high pressure gas stream, as shown in step 624.

The system can perform expanding the liquefied high pressure gas stream forming a low pressure liquefied natural gas stream that is sent to liquefied natural gas storage on the liquefied natural gas transport vessel, as shown in step 626.

The system can perform cooling a second portion of the high pressure liquefied natural gas inlet quality gas forming a precooled recycle refrigerant, as shown in step 628.

The system can perform expanding the precooled recycle refrigerant to form a cooled recycle refrigerant, as shown in step 630.

The system can perform using the cooled recycle refrigerant to provide cooling of various streams in the heat exchanger, including but not limited to, the first portion of the high pressure liquefied natural gas inlet quality gas, forming a low pressure recycle refrigerant, as shown in step 632.

The system can perform compressing the low pressure recycle refrigerant forming a recycle gas stream, as shown in step 634.

The system can perform exporting the recycle gas stream to the disconnectable turret, as shown in step 636.

The system can perform exporting the recycle gas stream through a second flexible conduit from the disconnectable turret to the floating production storage and offloading vessel, as shown in step 638.

The system can perform compressing the recycle gas stream and blending with the high pressure liquefied natural gas inlet quality gas on the floating production storage and offloading vessel, as shown in step 640.

The system can perform compressing a nitrogen recycle stream forming a high pressure nitrogen refrigerant stream, as shown in step 642.

The system can perform cooling the high pressure nitrogen refrigerant stream in the heat exchanger forming a precooled nitrogen refrigerant stream, as shown in step 644.

The system can perform expanding the precooled nitrogen refrigerant stream forming a cold nitrogen refrigerant, as shown in step 646.

The system can perform using the cold nitrogen refrigerant to provide cooling of various streams in the heat exchanger, including but not limited to, the first portion of the high pressure liquefied natural gas inlet quality gas and forming a low pressure nitrogen refrigerant, as shown in step 648.

The system can perform compressing the low pressure nitrogen refrigerant forming a nitrogen recycle stream, as shown in step 650.

The system can perform disconnecting the liquefied natural gas transport vessel from the disconnectable turret when sufficiently loaded, and allowing the liquefied natural gas transport vessel to travel to a transfer terminal for offloading to a trading tanker, as shown in step 652.

In one or more embodiments, a fixed production storage and offloading platform can be used instead of the floating production storage and offloading vessel.

The fixed production storage and offloading platform can have a primary processing unit mounted on the fixed production storage and offloading platform for receiving gas from a well; a gas treatment unit mounted on the fixed production storage and offloading platform for treating a process stream from the primary processing unit to produce treated inlet gas streams; and a first liquefaction portion that includes a natural gas compressor for receiving liquefied natural gas inlet quality gas, forming a high pressure liquefied natural gas inlet quality gas at a pressure from 1200 psia to 2000 psia. The platform can connect in a manner identical to the floating production storage and offloading vessel to the disconnectable turrets as shown in prior Figures.

While these embodiments have been described with emphasis on the embodiments, it should be understood that within the scope of the appended claims, the embodiments might be practiced other than as specifically described herein.

What is claimed is:

1. A method for offshore liquefaction of natural gas and transport of produced liquefied natural gas to a trading tanker comprising:

a. flowing well gas from a well into a primary processing unit mounted on a floating production storage and offloading vessel;

b. the floating production storage and offloading vessel performing the steps of:

i. separating condensate and water from the well gas forming a high pressure flash gas;

ii. sending high pressure flash gas to a gas treatment unit on the floating production storage and offloading vessel;

iii. removing acid gas from the high pressure flash gas forming a treated gas;

iv. removing water from the treated gas forming a dry gas and sending the dry gas to a dehydration unit;

v. removing propane, butane, pentane and heavier hydrocarbon compounds from the dry gas forming a liquefied natural gas inlet quality gas; and vi. compressing the liquefied natural gas inlet quality gas forming a high pressure liquefied natural gas inlet quality gas;

c. transferring the high pressure liquefied natural gas inlet quality gas to the disconnectable turret using a first flexible conduit;

d. transferring the high pressure liquefied natural gas inlet quality gas from the disconnectable turret to a liquefaction unit on a liquefied natural gas transport vessel and liquefying and expanding a first portion of the high pressure liquefied natural gas inlet quality gas for storage as liquefied natural gas, and cooling, expanding, and recompressing a second portion of the high pressure liquefied natural gas inlet quality gas into a recycle gas stream, wherein the liquefaction unit is powered by a propulsion means from the liquefied natural gas transport vessel, wherein the propulsion means is connected to a dual fuel diesel electric main power plant or a steam turbo-electric main power plant;

e. exporting the recycle gas stream through a second flexible conduit from the disconnectable turret to the floating production storage and offloading vessel;

f. compressing on the floating production storage and offloading vessel, the recycle gas stream and blending with the high pressure liquefied natural gas inlet quality gas;

g. disconnecting the liquefied natural gas transport vessel from the disconnectable turret when sufficiently loaded with liquefied natural gas and allowing the liquefied natural gas transport vessel to travel to a transfer terminal for offloading to the trading tanker; and h. separating wet gas stream to produce a low pressure wet natural gas stream and a plurality of intermediate pressure wet natural gas streams and compressing the low pressure wet natural gas stream and the intermediate pressure wet natural gas streams and comingling the compressed natural gas streams with the high pressure flash gas.

2. The method of claim 1, further comprising using processors of a controller to communicate to a network further in communication with client devices located remote of the liquefied natural gas transport vessel and the floating production storage and offloading vessel allowing remote monitoring of the processing of the natural gas.

3. The method of claim 1, further comprising using a turret receptacle and a means to recover and latch onto the disconnectable turret incorporated into the liquefied natural gas transport vessel.

4. The method of claim 3, further comprising using a turret access trunk with latching means connected to the turret receptacle for quickly engaging and disconnecting the liquefied natural gas transport vessel from the disconnectable turret.

5. The method of claim 1, further comprising using at least two articulated arms connected to the transfer terminal for offloading from the liquefied natural gas transport vessel to the trading tanker for moving the liquefied natural gas to market.

6. The method of claim 1, further comprising using at least two hoses connected to the transfer terminal for offloading from the liquefied natural gas transport vessel to the trading tanker for moving the liquefied natural gas to market.

7. The method of claim 1, further comprising using a dynamically positioned shuttle tanker for offloading from one of the liquefied natural gas transport vessels to the trading tanker.

8. The method of claim 1, wherein the liquefaction unit performs the steps of:

a. cooling, condensing and expanding the first portion of the high pressure liquefied natural gas inlet quality gas in the heat exchanger on the liquefied natural gas transport vessel forming a liquefied high pressure gas stream;

b. cooling expanding and using as a refrigerant, the second portion of the high pressure liquefied natural gas inlet quality gas stream, and then compressing the expanded stream to recycle to the disconnectable turret; and c. compressing a nitrogen recycle stream, cooling and expanding the high pressure nitrogen refrigerant stream forming a cold nitrogen refrigerant and using the cold nitrogen refrigerant to provide cooling of various streams in the heat exchanger, including but not limited to, the first portion of the high pressure liquefied natural gas inlet quality gas and forming a low pressure nitrogen refrigerant and compressing the low pressure nitrogen refrigerant forming a nitrogen recycle stream.

9. The method of claim 1, further comprising fractionating and stabilizing the dehydrated condensate, and sending the flash gas to a primary separation unit, and transferring stabilized condensate to storage on the floating production storage and offloading vessel.

* * * * *